United States Patent [19]

Babunovic et al.

[11] 4,108,774

[45] Aug. 22, 1978

[54] CONTAINER WASHER HAVING EXTERNAL LABEL FILTER AND SEPARATOR WITH FILTER FLUSHING MEANS

[75] Inventors: Momir Babunovic, Des Peres; Donald E. Whitlock, Creve Coeur, both of Mo.

[73] Assignee: Barry-Wehmiller Company, St. Louis, Mo.

[21] Appl. No.: 732,025

[22] Filed: Oct. 13, 1976

[51] Int. Cl.[2] ..... B08B 9/08

[52] U.S. Cl. ..... 210/167; 134/73; 134/104; 210/297

[58] Field of Search ..... 210/167, 393, 297; 134/18, 10, 23, 111, 73, 104

[56] References Cited

U.S. PATENT DOCUMENTS

| | | | |
|---|---|---|---|
| 1,151,999 | 8/1915 | Bird | 210/393 |
| 1,979,383 | 11/1934 | Gruetter | 210/297 |
| 2,311,391 | 2/1943 | Herold | 134/23 |
| 2,710,818 | 6/1955 | Winters | 134/18 |
| 2,734,635 | 2/1956 | Holzenthal | 210/393 X |
| 3,162,204 | 12/1964 | Babunovic et al. | 134/111 X |
| 3,868,960 | 3/1965 | Cove et al. | 134/73 |

FOREIGN PATENT DOCUMENTS

| | | | |
|---|---|---|---|
| 1,015,337 | 9/1957 | Fed. Rep. of Germany | 210/297 |

*Primary Examiner*—Frank A. Spear, Jr.
*Attorney, Agent, or Firm*—Gravely, Lieder & Woodruff

[57] ABSTRACT

A container washer equipped with external label filter means and label separator means connected in a two-stage circulating system in which a chamber for the label filter means receives washing solution burdened with labels from the container washer and the filter means holds out the labels so the washing solution returned to the container washer is free of labels and in which a portion of the washing solution burdened with labels filtered out by the filter means is drawn into a label separator means which extracts the labels and delivers label free washing solution to the filter means to flush off labels that may cling to the filter means.

11 Claims, 5 Drawing Figures

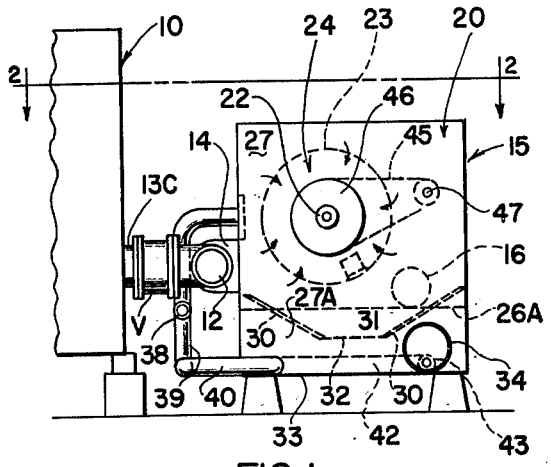
FIG. 1
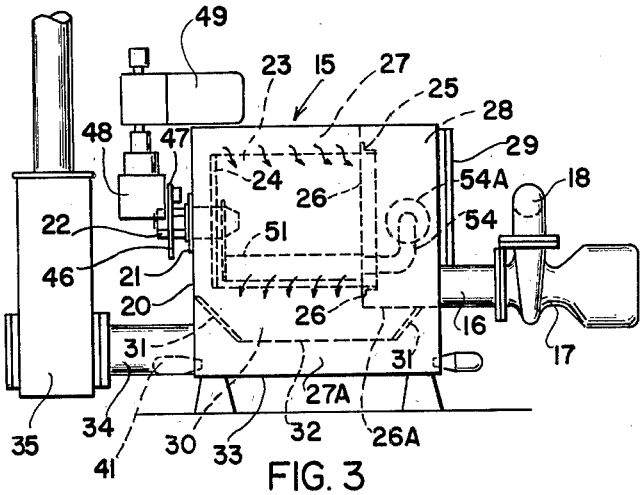
FIG. 3
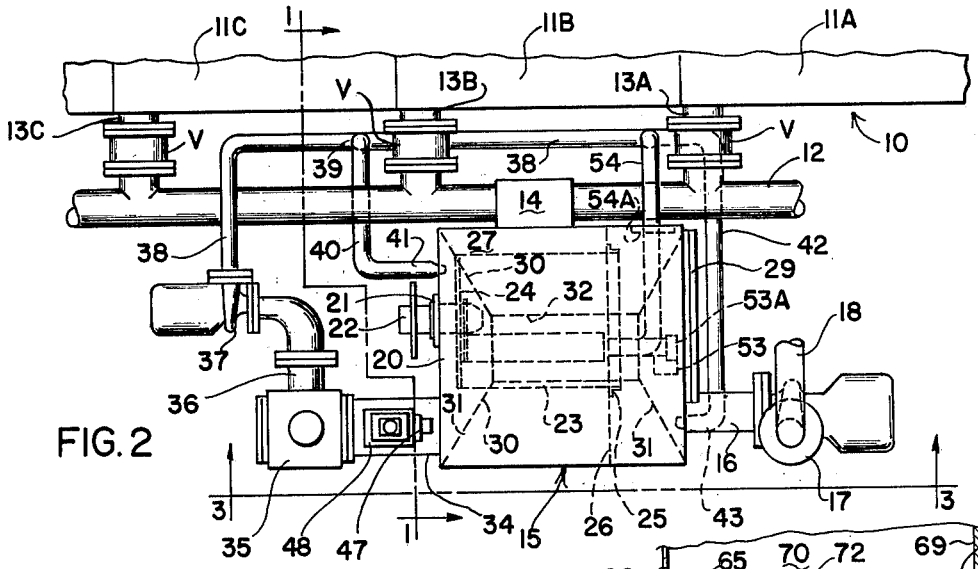
FIG. 2
FIG. 5
FIG. 4
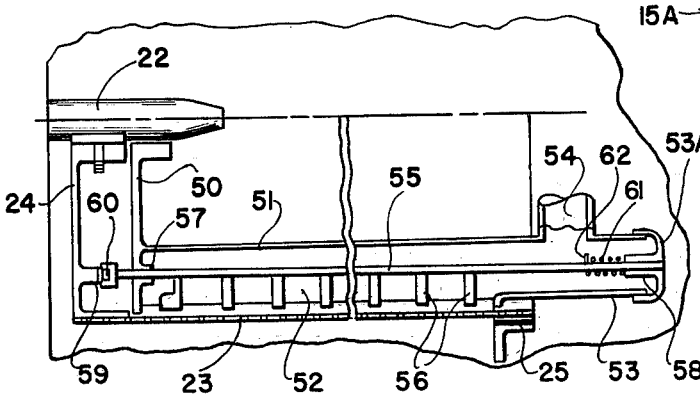

CONTAINER WASHER HAVING EXTERNAL LABEL FILTER AND SEPARATOR WITH FILTER FLUSHING MEANS

BACKGROUND OF THE INVENTION

There are many forms of container washers in which the objective is to receive containers in a haphazard condition and to thoroughly clean and sterilize the internal surfaces as well as to completely remove neck and body labels so that the containers delivered at the discharge of the washers are in a sterile, clean and bright condition. One of the problems in container washers is concerned with the removal of the labels with as much delicacy as possible so as to reduce the amount of shredding and pulping of the labels, thereby reducing the contamination of the hot caustic solution which is generally utilized to effect the cleaning and sterilizing of the containers as well as to attack the adhesive utilized for affixing the labels.

In one form of container washer which is illustrated in Winters U.S. Pat. No. 2,710,818 of June 14, 1955, the apparatus is designed to produce pulping of the labels internally of the washer, followed by delivery of the pulp contaminated caustic solution to external settling tanks before returning the decanted solution to the washer. The problem with this approach resides in the excessive contamination of the caustic solution and the need to allow sufficient settling time for the pulp.

Another approach to apparatus for removing labels from container washers is disclosed is Babunovic et al U.S. Pat. No. 3,162,204 of Dec. 22, 1964. In this apparatus the accumulation of labels within the washer is maintained at a minimum by constantialy jetting the labels into an external system where the labels are forcibly extracted from the washing solution before the solution is returned to the washer. The extraction of the labels from the washing solution is quite efficient but it is necessary to limit the number of compartments in the washer that can be serviced at one time.

A more recent arrangement for removing labels from container washing solution is found in Cove et al U.S. Pat. No. 3,868,960 of Mar. 4, 1975 where the solution burdened with labels is delivered by the difference in hydrostatic levels to an external tank in which a rotating screen lifts the labels out of the washing solution to an elevated position where the labels can be removed from the rotating screen and directed out of the tank above the level of the washing solution so as to clear the solution from carrying labels back to the washer and the suction out of the external tank.

BRIEF DESCRIPTION OF THE INVENTION

This invention relates to container washer label removal systems and is particularly directed to improvements in the handling of labels externally of the container washer.

The objects of this invention are to provide a label removal system for container washers with improved means to carry the accumulating labels out of the washer for transfer to extraction means, to provide novel means to handle the label transfer externally of the container washer, to provide means that can accommodate a plurality of compartments in the container washer at the same time, and to provide a label removal system having improved efficiency in handling a high volume of labels with significant reduction in the shredding and/or pulping of the labels.

A preferred embodiment of the present invention resides in the improvement in the container washer of a first washing solution circulating system arranged to move washing solution burdened with labels out of the container washer and return only washing solution substantially clear of labels, a second washing solution circulating system arranged to extract container labels from the washing solution burdened with labels moved by the first circulating system, and means common to the first and second circulating systems to effect the transfer of the labels between such systems.

More particularly the present invention resides in the improvement of a casing outside of the container washer arranged to have first and second chambers in communication through a separating wall, an inlet to the casing to direct washing solution burdened with labels from the container washer, label filter means in the first chamber at the open connection with the second chamber and operatively mounted for rotation, means to flush the filter means so as to prevent clogging by label accumulation thereon, means to return label free washing solution from the second chamber to the container washer, and a second circulating system for removing washing solution burdened with labels from the first chamber of the casing to a label separating means and to return substantially free washing solution back to the external casing.

BRIEF DESCRIPTION OF THE DRAWINGS

A preferred embodiment of the present invention is shown in the accompanying drawings, wherein:

FIG. 1 is an end elevation of a fragmentary portion of a container washer associated with the apparatus for label removal from the container washing solution externally of the container washer;

FIG. 2 is a plan view of the apparatus seen at line 2—2 in FIG. 1;

FIG. 3 is a side elevation view as seen at line 3—3 in FIG. 2;

FIG. 4 is an enlarged fragmentary detailed view of means for flushing labels from the washing solution filter means; and FIG. 5 is an enlarged and fragmentary side view of a modified label filtering device, the view being taken in like manner as for FIG. 3.

DETAILED DESCRIPTION OF THE PREFERRED EMBODIMENT

The present label removal system for container washers is depicted in FIGS. 1 and 2 in association with a container washer 10 having compartments 11*A*, 11*B* and 11*C* (FIG. 2) connected into a common drain header 12 by individual drain pipes 13*A*, 13*B* and 13*C* respectively. Each drain pipe has a suitable valve V for purposes of cutting off any compartment when desired. The common header 12 is connected at fitting 14 into a casing 15 which forms an essential part of the label removal system. The container washer depicted at 10 may be constructed in accordance with the washer shown and described in the copending U.S. application for patent of Babunovic et al, Ser. No. 669,043, filed Mar. 22, 1976, now Pat. No. 4,044,783 and assigned in common with this application. While washing solution burdened with labels flows out at drain pipes 13*A*, 13*B* and 13*C* from the several compartments in the washer 10, the solution freed of its burden is drawn out of the casing 15 by pipe 16 at the suction inlet to pump 17 and returned to the several compartments at pump outlet pipe 18. The piping arrangement connected to pipe 18 is not shown, but can be similar to the system disclosed in the copending application of Babunovic et al, Ser. No. 669,043, and reference to that application is made for the details thereof.

Turning now to FIGS. 1, 2 and 3, the casing 15 has one vertical end wall 20 carrying a suitable bearing 21 for supporting a shaft 22 which projects into the casing 15 to support and rotate a label filter means which is in the form of a hollow cylindrical or drum type screen 23 from one end disc 24 of the screen. The opposite axial end of the filter screen 23 is open but is supported in an annular bearing 25 mounted in a divider partition 26 which separates the filter screen chamber 27 from a discharge chamber 28. The fitting 14 opens into the chamber 27 and the suction pipe 16 for pump 17 opens into the chamber 28. The chamber 28 has an access door 29 in its end wall for purposes of installing or removing the filter screen and for general assembly and servicing of the screen and supported means. The partition 26 extends across the width of the casing 15 and extends vertically to a floor 26*A* (FIGS. 1 and 3) at the level of the suction pipe 16 for the pump 17. Thus, the chamber 28 is isolated from chamber 27 except through the rotating filter screen 23.

The chamber 27 in casing 15 is provided below the screen 23 with spaced side baffle plates 30 and end baffle plates 31 which are slanted and have the lower margins in a common plane to form a rectangular opening 32 which is spaced above the bottom wall 33 of the casing 15. The space 27*A* in casing 15 below the baffles 30 and 31 is divided out of the chamber 27 and acts as a settling space for the labels brought into the chamber 27 at fitting 14. The settling space 27*A* is open to an outlet conduit 34 which connects into the bottom end of a screw-type label separator 35 of the character disclosed in Babunovic et al U.S. Pat. No. 3,322,283 granted May 30, 1967. The separator 35 has a label free solution outlet pipe 36 (FIG. 2) connected to a pump 37 which directs the solution into pipe 38. Pipe 38 has a branch 39 connected into a feed line 40 for a nozzle 41 in the bottom space 27*A* of the casing 15. Further, the pipe 38 connects with a second feed line 42 for a second nozzle 43 in the bottom space 27*A* of the casing 15. The two nozzles 41 and 43 are arranged to stimulate the circulation of the washing solution in the bottom space 27*A* below the baffles 30 and 31 in a direction (Clockwise) to carry the solution burdened with labels into the outlet conduit 34. This circulation is confined by the baffles 30 and 31 to remain generally in a horizontal plane and the circulation has the intended good effect to encourage labels in the upper portion of the chamber 27 to move through the opening 32 toward the lower space 27*A* and eventually into the separator 35.

As shown in the drawings (FIGS. 1, 2 and 3), the filter screen 23 is rotated by a suitable drive chain 45 from the sprocket 46 on the filter screen shaft 22 to a power take-off sprocket 47 operated through suitable gears in box 48 (FIG. 3). The gear box 48 is incorporated as a part of the drive 49 for the screw means (not shown) in the separator 35. The filter screen 23 rotates in the body of washing solution in chamber 27 which is burdened with labels, and the suction draw of pump 17 in the chamber 28 draws the solution through the screen and leaves the labels and pulp on the screen. Constant removal of the labels is required to prevent clogging the screen; and is accomplished as follows.

In FIG. 4 the filter screen 23 is fixed to the end disc 24 which, in turn, is keyed to the rotatable shaft 22. The shaft 22 supports a pendulous arm 50 adjacent the disc 24, and the arm 50 supports the end of a flush duct 51 which is formed with an elongated slot 52 opening toward the inner surface of the screen 23. The duct 51 extends throughout the cylindrical length of the screen and parallel to its axis of rotation to an outer end 53 which is closed by a cap 53*A*. The end 53 has a side connection with a feed pipe 54 which extends across the chamber 28 and outside to a connection with the conduit 38 (FIG. 2). The slot 52 in the duct 51 is kept open by a bar 55 carrying a plurality of comb teeth 56 projected into the slot 52. The bar 55 is longitudinally slidable at one end in a bearing 57 in the pendulum arm 50, and the opposite end is slidable in a bearing 58 in the cap 53*A*. Reciprocation of the rod 55 is achieved during screen rotation through the placement of an annular cam track 59 on the end disc 24 in position to be engaged by a roller follower 60 on the rod 55. The roller 60 is constantly pressed against the cam track 59 by the provision of a spring 61 pushing on a shoulder 62 fixed on rod 61 and the fixed bearing 58 in the cap. As the screen rotates the cam track 59 will reciprocate the bar 55 and comb teeth 56 in the slot 52 of the flushing duct 51. The duct 51 is adequately supported in operative position by the pendulus arm 50 and by the pipe 54 mounted at 54*A* in the casing 15.

FIG. 5 is a modified rotary screen that may be substituted for the unit seen in FIG. 3. The modified rotary screen can be mounted in a suitably modified casing 15*A* in the following manner: The shaft 22 carried by bearing 21 in the wall 20 supports a large disc 65 which supports a cam ring 66, and an adjacent smaller disc 67 which carries a cam ring 68. The casing interior is divided by a wall 69 into a space 70 for receiving washing solution burdened with labels at fitting 14 from the several compartments of the washer 10, as seen in FIGS. 1 and 2. The wall 69 is formed with an opening in which a suitable bearing 71 is mounted to receive the open end of a first screen 72, the opposite end of the screen 72 being attached to the large disc 65 for purposes of rotating the screen in the bearing 71. Wall 69 is formed with an extension wall 73 formed with an opening defined by a suitable bearing 74 to support the open end of a second screen 75, the opposite end being connected to the smaller disc 67 for purposes of rotating the screen 75 simultaneously with the larger screen 72. The opening in wall 73 communicates with a second space 76 for washing solution substantially free of labels and pulp particles. The washing solution in space 76 must pass through the coarse mesh screen 72 with openings of the order of nine-thirty seconds inch, and then through the fine mesh screen 75 with openings of the order of one-sixteenth inch.

As before described, casing 15*A* also receives washing solution burdened with labels (see FIGS. 1 and 2) from one or more compartments 11*A*, 11*B* and 11*C* through drain header 12 and fitting 14. The flow is into space 70 generally tangentially of the screen 72 so that labels may fall toward the bottom of the casing below baffles 77 and 77*A* where the outlet conduit 78 connects into the bottom of the separator 35 heretofore described in FIG. 2 and FIG. 3. The labels collecting on the exterior of the coarse screen 72 are continually flushed off by the provision of a flush duct 79 which extends into the space 80 between screens 72 and 75 from a supporting conduit 81 which penetrates the space 76. The duct 79 is similar to flush duct 57 seen in FIG. 4 and is provided with a comb tooth bar (not shown) which constantly reciprocates between the cam ring 66 and a reaction spring (not shown) in the cap 82. The flushing duct 79 is supported at its inner end by an arm 83 from the shaft 22, the arm being free on the shaft 22. Conduit 81 supplies fluid from the separator 35 to the flush duct 79. Thus, washing solution substantially free of labels and large particles of pulp and the like is received in the annular space between screens 72 and 75.

The fine screen 75 is in position to filter out fine particles and pulp as the washing solution passes into the second or interior space 76 where it flows into the suction pipe 16 for pump 17. As before described, pump 17 has its outlet pipe 18 connected into the several compartments, as set forth in copending application of Babunovic et al, Ser. No. 669,043 and reference is made to that application for details thereof. Constant flushing of the fine screen 75 is obtained by a flushing duct 84 extending along the screen and supported by the fluid supply pipe 85 so that a reciprocating comb tooth bar (not shown) can be mounted in the duct 84 to be actuated by the cam ring 68 and a reaction spring (not shown) in the opposite end cap 86 for duct 84. The pipe 85 is connected into the outlet pipe 18 for pump 17 in a suitable place. The inner end of duct 84 is supported by an arm 87 which is free on the shaft 22.

The ducts 79 and 84 are similar to the duct 51 shown in FIG. 4, and the comb tooth bar for each duct is in the form shown in that view, both as to function and as to the manner of its mounting. The view of FIG. 5 depicts the duct 84 to be at the top of the vertical diameter for screen 75, and duct 79 to be at the bottom of the vertical diameter for screen 72. This shown has been selected for convenience of drawing, and therefore it must be recognized that other positioned locations for these ducts 79 and 84 may be selected.

OPERATION OF THE LABEL REMOVAL SYSTEM

It can be best seen in FIG. 2 that the compartments in the container washer 10 are connected to a common header pipe 12 for simultaneous delivery of washing solution burdened with labels to the fitting 14 on the present external label transfer casing. The casing can be either the one seen at 15 in FIG. 3 or the casing 15*A* seen in FIG. 5. The transfer of lables, for example in the casing 15, occurs in the first chamber 27 by the motor driven pump 17 drawing the washing solution through the filter screen 23 into the second chamber 28 and into the suction pipe 16 for return of washing solution by pipe 18 back to the container washer 10. This program of washing solution flow represents the first circulating system. The second and cooperating circulating system comprises the motor driven pump 37 connected into the label separator 35 which in turn imposes a suction draw through pipe 34 connected into the chamber 27 containing the rotating filter screen 23. The pump 37 delivers label free washing solution through pipe 38 to the nozzle means 41 and 43 located in the bottom of the chamber 27 of casing 15 and simultaneously delivering washing solution through pipe 54 to the duct 51 which is located internally of the rotating screen 23 which is common to the two circulating systems. The duct 51 acts for continually flushing labels adhering to the screen so as to keep the screen from clogging. The second circulating system exerts a substantial part of its effect in the casing 15 at a location below the rotating filter screen 23. An important feature of the second circulating system is the provision of baffle plates 30 and 31 between the rotating filter 23 and the bottom jets 41 and 43 for the purpose of establishing a horizontal movement of accumulating labels flushed off of the screen 23 in a direction toward the suction pipe 34 for this label separator 35.

In the view of FIG. 5, as applied to the other relevant views, the washing solution burdened with labels and other matter is admitted to the casing 15*A* at fitting 14 and encounter the coarse mesh screen 72. Labels and matter unable to pass the screen pores will be arrested and rotated under the flushing duct 79 where it is flushed off and falls down past baffles 77 and 77*A* into the bottom of the casing where it is withdrawn at suction outlet 78 due to the operation of the separator 35. The solution which passes screen 72 encounters the fine mesh screen 75, and matter unable to pass this fine screen is collected in space 80 where it will fall to the bottom of screen 72 and be flushed through the coarse screen 72. The cleaned washing solution passes screen 75 and is drawn through the space 76 into the pipe 16 for pump 17 and returned to the washer compartments for the washer 10.

The above described embodiment, as well as the modification therein, has the unique feature of applying a two-stage label removal system to a container washer for the purpose of significantly minimizing pulp build up in the washing solution by having the bulk of the rough handling of labels occurring in a closed loop system substantially separated from the container washer and protected from the circulating system directly connected to the container washer by an arrangement of baffles. A further unique feature of the present disclosure resides in locating the circulation system through the separator 35 from the casing 15 or 15*A* such that when there is a difference in the level of the washing solution in the washer 10 and in the column of the separator 35 there will be exerted on the separator 35 the pressure represented by the hydrostatic head, communicated through the flooded casing 15 which is below the level of washing solution in the washer 10, for breaking up any blockage in the separator 35 or in its feed pipe 34 due to accumulation of labels and pulpy matter. It should now be clear that the present washing label removal system embodies a circulating system for washing solution between the washer tank and the casing 15 or 15*A* and back through the pump 17 and the return pipe 18 which is independent of a circulating system involving the label separator 35 which is connected in fluid association with the casing 15 or 15*A* for handling washing solution burdened with labels and pulpy matter, whereby the handling of labels and pulpy matter takes place outside of the washer tank 10 so as to substantially eliminate rough handling of labels which can occur at the rotary screen 23 or at the dual rotary screens 72 and 75. Should labels accumulate at the entrance to the separator 35, such as in pipe 34 or pipe 78, the separator pump 37 will reduce the level of washing solution in the separator column and thereby increase the hydrostatic head, thereby adding the pressure of the hydrostatic head to the suction effect of pump 37 so as to break up the blockage and restore the system to normal operation.

What is claimed is:

1. In container washer apparatus for clearing labels which have become detached from containers from container washing solution, the improvement in the container washer apparatus of: a casing structure external to the container washer formed with a filter chamber and a discharge chamber in flow communication, conduit means connected between said container washer and said filter chamber for delivery thereto of washing solution burdened with labels, filter means in said filter chamber positioned for intercepting labels in the washing solution as it flows into said discharge chamber, first washing solution circulating means connected between said discharge chamber and said container washer for establishing a flow of washing solution burdened with labels into said filter chamber and washing solution substantially free of labels back to said container washer; and second washing solution circulating means including label separator means having an inlet connected into said filter chamber to receive washing solution burdened with labels intercepted by said filter means the connection of said separator means with said filter chamber subjecting said separator means to a hydrostatic head pressure, said separator means having a first outlet for discharge of labels and a second outlet for discharge of washing solution substantially free of labels, and a conduit connected to said second outlet and extending to a discharge end adjacent said filter means in said filter chamber for applying washing solution to said filter means for dislodging labels from said filter means.

2. The improvement of claim 1 wherein said container washer includes a plurality of compartments, and said conduit means connected between said container washer and the interior of said filter chamber includes individual drain pipes from said compartments, a common header pipe connected to said drain pipes and to said filter chamber, and valve means disposed in each of said drain pipes for cutting off flow from any of said compartments.

3. The improvement of claim 1, wherein said filter chamber is flooded with washing solution burdened with labels, and said filter means is rotated relative to said discharge end for said conduit connected to said second outlet of said label separator means.

4. The improvement of claim 1, wherein means disposed in said filter chamber below said filter means to form a collecting space for labels intercepted by said filter means, and said label separator means inlet connected into said filter chamber is open to said collecting space.

5. In container washer apparatus for clearing labels which have become detached from containers from container washing solution, the improvement in the container washer apparatus: of a casing having internal wall means dividing the casing into first and second spaces in communication through an opening in said internal wall means; an inlet fitting on said casing connected to the container washer and opening to said first space to direct washing solution burdened with labels from the container washer into said first space to totally flood said first space; an outlet from said second space; filter means mounted in said first space to be submerged in said washing solution and cover said opening through said internal wall means to said second space; means connected to rotate said filter means; filter flushing means positioned adjacent said filter means; first washing solution circulating means connected into the outlet from said second space for establishing a flow of washing solution substantially clear of labels back to the container washer and a flow of washing solution burdened with labels to said casing; a second washing solution circulating means having an inlet connected to said first space of said casing and an outlet connected to said filter flushing means to supply washing solution to flush labels off said filter means; and means in said second washing solution circulating means operative to receive the labels collecting in said first space and flushed off said filter means and to extract the labels from the washing solution and discharge the labels to atmosphere.

6. The improvement of claim 5, wherein said filter means is a hollow interior cylindrical screen mounted to rotate in said opening in said internal wall means with the hollow interior open to said second space, and said filter flushing means is adjacent said cylindrical screen in position to deliver washing solution against said cylindrical screen for flushing off labels.

7. The improvement of claim 5, wherein baffle means is mounted in said first space, below said filter means, and said second washing solution circulating means has its inlet connected into said first space below said baffle means.

8. The improvement of claim 5, wherein said filter flushing means comprises a duct having an outlet slot adjacent said filter means, and means operable in said outlet slot to maintain said outlet slot clear of obstruction.

9. In container washer apparatus for clearing labels which have become detached from containers from container washing solution the improvement comprising: a container washer tank; drain means connected adjacent the bottom of said tank to pass washing solution burdened with labels out of said washer tank; casing means connected to said drain means to receive the washing solution burdened with labels, said casing means having spaced washing solution outlets, and filter means operably disposed in said casing means to be submerged in washing solution and in position separating said outlets one from the other with one of said outlets being on the opposite side of said filter means from the other outlet; means operably connected to said filter means for rotating the same; first circulating means connected to said one outlet and to said washer tank to return washing solution substantially free of labels to said washer tank; and second circulating means connected to said other outlet and having a flow connection back into said casing to adjacent said filter means, said second circulating means including means to separate out labels from the washing solution, whereby washing solution flows substantially free of labels from said separator means to said filter means for maintaining said filter means free of labels and said second circulating means being effective to cause the labels delivered into said casing to move toward said other outlet.

10. The apparatus set forth in claim 9 wherein the level of washing solution in said label separator means normally approaches the level of washing solution in said washer tank, and said second circulating means includes pump means to vary the washing solution level in said separator means in relation to the accumulation of labels at said other outlet, whereby on label accumulation severely diminishing flow of washing solution the level in said separator means falls and the differences in levels in said washer tank and separator means increases the hydrostatic head of liquid at said other outlet to restore the normal levels of washing solution.

11. The apparatus set forth in claim 9 wherein said filter means includes a pair of rotary screens concentrically nested and separating said outlets, said first circulating means includes a washing solution flow connection open to one of said rotary screens to flush said rotary screen, and said washing solution flow connection from said separator means to said filter means is associated with the other of said rotary screens.

* * * * *